US007803747B2

(12) United States Patent
Dingess

(10) Patent No.: US 7,803,747 B2
(45) Date of Patent: Sep. 28, 2010

(54) DETERGENT COMPOSITION FOR HALOGENATED DRY CLEANING SOLVENTS

(75) Inventor: John A. Dingess, Hanover Park, IL (US)

(73) Assignee: Enviro Tech International, Inc., Melrose Park, IL (US)

( * ) Notice: Subject to any disclaimer, the term of this patent is extended or adjusted under 35 U.S.C. 154(b) by 344 days.

(21) Appl. No.: 12/104,918

(22) Filed: Apr. 17, 2008

(65) Prior Publication Data

US 2008/0274935 A1 Nov. 6, 2008

Related U.S. Application Data

(60) Provisional application No. 60/927,118, filed on May 1, 2007.

(51) Int. Cl.
*C11D 3/24* (2006.01)
*C11D 3/44* (2006.01)
*C11D 1/38* (2006.01)

(52) U.S. Cl. ..... 510/285; 510/276; 510/286; 510/407; 510/432; 510/504; 510/525

(58) Field of Classification Search ..... 510/285, 510/276, 286, 407, 432, 504, 525
See application file for complete search history.

(56) References Cited

U.S. PATENT DOCUMENTS

| | | | | |
|---|---|---|---|---|
| 3,222,286 | A | 12/1965 | Barnes | 252/161 |
| 3,335,093 | A | 8/1967 | Gilbert et al. | 252/170 |
| 3,838,967 | A | 10/1974 | Shepley | 8/111 |
| 4,013,575 | A * | 3/1977 | Castrantas et al. | 510/286 |
| 4,014,805 | A * | 3/1977 | Castrantas | 510/286 |
| 4,659,332 | A * | 4/1987 | Hellsten | 8/142 |
| 5,616,549 | A | 4/1997 | Clark | 510/412 |
| 5,690,862 | A | 11/1997 | Moore, Jr. et al. | 252/364 |
| 5,707,954 | A | 1/1998 | Lee | 510/412 |
| 5,858,953 | A | 1/1999 | Aman et al. | 510/412 |
| 5,938,859 | A | 8/1999 | Clark et al. | 134/31 |
| 6,258,770 | B1 * | 7/2001 | Shubkin et al. | 510/412 |
| 6,402,857 | B2 | 6/2002 | Clark et al. | 134/31 |
| 2007/0028396 | A1 * | 2/2007 | Middleton | 8/137 |

FOREIGN PATENT DOCUMENTS

| | | |
|---|---|---|
| GB | 1 291 168 | 10/1972 |
| JP | 2004018789 | 1/2004 |
| WO | WO 01/53598 | 7/2001 |

OTHER PUBLICATIONS

Website at www.laidlawcompany.com/industrial/chemicals/normandy.htm, 2 pages (Mar. 19, 2007).
Normandy Injection Detergent MSDS from Laidlaw Corporation prepared by John T. Beckman.
International Search Report, in counterpart International Application No. PCT/US2008/060617, dated Oct. 13, 2008 (4 pgs.).
Written Opinion of the International Searching Authority, in counterpart International Application No. PCT/US2008/060617, dated Oct. 13, 2008 (7 pgs.).
International Preliminary Report on Patentability in counterpart International Application No. PCT/US2008/060617, dated Nov. 3, 2009 (8 pgs.).

* cited by examiner

*Primary Examiner*—Charles I Boyer
(74) *Attorney, Agent, or Firm*—Marshall, Gerstein & Borun LLP

(57) ABSTRACT

A composition that optimizes the performance and maintenance of halogenated dry cleaning solvents is disclosed. One embodiment of a detergent composition for use with halogenated dry cleaning solvents includes water, a surfactant, a solubilizer, a coupling agent, an acid-accepting stabilizer, and a halogenated solvent. Optionally, the composition can include an oil-based fragrance and/or an optical brightener. When used in a dry cleaning process, the detergent composition replenishes the acid-accepting stabilizer depleted from the dry cleaning solvent and the halogenated solvent suppresses the flash point of the acid-accepting stabilizer.

18 Claims, No Drawings

DETERGENT COMPOSITION FOR HALOGENATED DRY CLEANING SOLVENTS

CROSS-REFERENCE TO RELATED APPLICATION

The benefit under 35 USC §119(e) of U.S. provisional patent application Ser. No. 60/927,118 filed May 1, 2007, the disclosure of which is incorporated herein by reference, is claimed.

BACKGROUND OF THE INVENTION

1. Field of the Disclosure

The present disclosure relates to the dry cleaning of clothes, rugs, and other fabrics and, more particularly, to the use of water-injecting detergents for halogenated dry cleaning solvents.

2. Brief Description of Related Technology

Historically, perchloroethylene, hydrocarbons, and silicon-based solvents, for example, have been used to dry clean fabrics. All of these dry cleaning solvents have disadvantages that render their use unfavorable. Perchloroethylene is a carcinogen, hydrocarbons are flammable, and silicon-based solvents do not clean as well as the other solvents.

Like other lipophilic dry cleaning solvents, provision must be made to remove the hydrophilic stains as well as the lipophilic stains on fabric. In addition to spot cleaning fabrics before they are dry-cleaned, water-injecting detergent formulations can be used to remove the hydrophilic stains. The detergent formulations can also contain cationic surfactants that enhance fabric softening and reduce static cling. The water-injecting detergent can be metered in automatically as a separate package into the dry cleaning machine.

SUMMARY OF THE INVENTION

A composition is provided that optimizes the performance and maintenance of halogenated dry cleaning solvents.

One embodiment of a detergent composition for use with halogenated dry cleaning solvents includes water, a surfactant, a solubilizer, a coupling agent, an acid-accepting stabilizer, and a halogenated solvent. Optionally, the composition can include an oil-based fragrance and/or an optical brightener.

Another embodiment of the composition includes a detergent composition for use with halogenated dry cleaning solvents having about 10 wt. % to about 90 wt. % water; about 1 wt. % to about 60 wt. % of a cationic surfactant or a blend thereof, about 0.1 wt. % to about 5 wt. % of an alcohol solubilizer; about 1 wt. % to about 20 wt. % of an alkylene glycol coupling agent; about 1 wt. % to about 10 wt. % of an acid-accepting epoxide stabilizer selected from 1,2-epoxybutane, pentylene oxide, hexylene oxide, and mixtures thereof, and, about 1 wt. % to about 30 wt. % of n-propyl bromide, based on the total weight of the detergent composition.

DETAILED DESCRIPTION OF THE INVENTION

The detergent compositions of the disclosure are useful in combination with halogenated dry cleaning solvents. The detergent compositions generally include water, a surfactant, a solubilizer, a coupling agent, an acid-accepting stabilizer, and a halogenated solvent. The detergent compositions can optionally include an oil-based fragrance and/or an optical brightener.

Water is the primary vehicle of the detergent composition, and it assists in removing water-soluble stains from a dry-cleaned object. Water is generally included in an amount of about 10 wt. % to about 90 wt. %, for example about 20 wt. % to about 70 wt. %, or about 34 wt. %, based on the total weight of the detergent composition.

The halogenated solvent of the detergent composition both suppresses the flash point of the detergent composition and replenishes solvent lost from the dry cleaning solvent when the dry cleaning solvent is distilled and recycled. The halogenated solvent is generally selected from n-propyl bromide, perchloroethylene, trichloroethylene, and mixtures thereof. The halogenated solvent preferably includes n-propyl bromide. The halogenated solvent is generally included in an amount of about 1 wt. % to about 30 wt. %, for example about 3 wt. % to about 20 wt. %, or about 12 wt. %, based on the total weight of the detergent composition.

Compared to prior art dry cleaning solvents, n-propyl bromide is a favorable dry cleaning solvent to use for several reasons: n-propyl bromide is not a carcinogen, is not flammable, and is a good lipophilic solvent. Furthermore, n-propyl bromide has a higher vapor pressure and lower boiling point than perchloroethylene, thereby requiring less energy to heat.

Like perchloroethylene and other halogenated solvents, n-propyl bromide must be inhibited with an acid-accepting stabilizer so that it does not degrade to form hydrobromic acid and organic acids to become corrosive toward metals. In a dry cleaning machine, solvent is distilled to separate the body oils and other soils from the dry cleaning solvent. In addition, water is separated from the dry cleaning solvent. These processes can deplete the acid-accepting stabilizers and degrade the dry cleaning solvent, if the stabilizers are not replaced.

Thus, the detergent composition also includes an acid-accepting stabilizer to stabilize the dry cleaning solvent and to replenish stabilizers lost from the dry cleaning solvent when the dry cleaning solvent is distilled and recycled. The acid-accepting stabilizer is generally an alkylene epoxide, for example an epoxide selected from 1,2-epoxybutane (i.e., butylene oxide), pentylene oxide, hexylene oxide, and mixtures thereof. The acid-accepting stabilizer preferably includes 1,2-epoxybutane. The acid-accepting stabilizer is generally included in an amount of about 1 wt. % to about 10 wt. %, for example about 1 wt. % to about 7 wt. %, or about 4 wt. %, based on the total weight of the detergent composition.

The detergent composition includes a surfactant to remove water-soluble stains from, and reduce static cling on, a dry-cleaned object. Suitable surfactants can include cationic surfactants, anionic surfactants, non-ionic surfactants, and amphoteric surfactants. The surfactant generally includes at least one cationic surfactant, for example at least one quaternary cationic surfactant selected from the group consisting of tallowammonium ethosulfate, dioleyl amidoamine dimethyl sulfate, cocamine methyl chloride, mono-oleyl imidazoline diethyl sulfate, dioleyl imidazoline dimethyl sulfate, ditallow amidoamine dimethyl sulfate, and mixtures thereof. The surfactant preferably includes a blend of at least two cationic surfactants. The surfactant (either in general or as at least one cationic surfactant) is generally included in an amount of about 1 wt. % to about 60 wt. %, for example about 10 wt. % to about 55 wt. %, or about 40 wt. %, based on the total weight of the detergent composition. The surfactant can additionally include up to about 40 wt. % of a non-ionic surfactant, based on the total weight of the detergent composition. Suitable non-ionic surfactants include, for example, those selected from the group consisting of secondary alcohol ethoxylates, octyl phenol ethoxylates, nonyl phenol ethoxylates, ethoxylated alkanolamides, fatty acid esters, ethoxylated phosphate esters, phosphate esters, oxyethylated isononylphenols, diethanolamine, sorbitan esters, polydimethylsiloxanes, alkyl-dimethicone copolyols, and mixtures thereof. For example, non-ionic surfactants can include a poly(oxy-1,2-ethanediyl) surfactant and/or an α-(4-nonylphenyl)-ω-hydroxy surfactant.

The surfactant can further include an anionic surfactant. Suitable anionic surfactants include, for example, those selected from the group consisting of petroleum sulfonates, sodium sulfosuccinates, sodium alkylarenesulfonates, amine alkylarene sulfonates, linear alkyl benzenesulfonic acid salts, alkaryl sulfonates, sodium sulfonates, sulfosuccinates, fluorinated carboxylic acids and their derivatives, and mixtures thereof.

Suitable amphoteric surfactants include, for example, amine oxides, betaines, sultaines, acetates, glycinates, imidazolines, propionates, and mixtures thereof.

The detergent composition includes a solubilizer to assist in dissolving and removing ionic soils from a dry-cleaned object. The solubilizer generally includes an alcohol, for example selected from the group consisting of methanol, ethanol, isopropanol, n-propanol, and mixtures thereof. The solubilizer preferably includes isopropanol. The solubilizer is generally included in an amount of about 0.1 wt. % to about 5 wt. %, for example about 0.5 wt. % to about 2 wt. %, or about 1 wt. %, based on the total weight of the detergent composition.

The detergent composition includes a coupling agent. The coupling agent couples the surfactants and water of the detergent composition into a homogeneous mixture. The coupling agent also assists in dissolving and removing ionic soils from a dry-cleaned object. The coupling agent generally includes an alkylene glycol, for example selected from the group consisting of ethylene glycol, diethylene glycol, triethylene glycol, propylene glycol, dipropylene glycol, tripropylene glycol, butylene glycol, pentylene glycol, hexylene glycol, heptylene glycol, and mixtures thereof. The coupling agent preferably includes hexylene glycol. The coupling agent is generally included in an amount of about 1 wt. % to about 20 wt. %, for example about 2 wt. % to about 15 wt. %, or about 6 wt. %, based on the total weight of the detergent composition.

The detergent composition optionally includes an optical brightener to brighten a dry cleaned object. The optical brightener can include compounds having benzenesulfonic or stilbene functionality, for example benzenesulfonic acid or stilbene-based fluorescent brighteners (e.g., 2,2'-([1,1'-biphenyl]-4,4'-diyldi-2,1-ethendiyl) bis- and disodium stilbene). When present, the optical brightener is generally included in an amount of about 0.01 wt. % to about 0.3 wt. %, for example about 0.02 wt. % to about 0.2 wt. %, or about 0.05 wt. %, based on the total weight of the detergent composition.

Although n-propyl bromide has a characteristically sweet odor, fragrance can be added to provide clean and fresh smelling clothes and other fabrics. The solvent distillation step in a dry cleaning process can remove fragrance from the halogenated solvent. Fragrance must be replaced in the solvent to keep the clothes and other fabrics smelling fresh and clean. Thus, the detergent composition optionally includes an oil-based fragrance to impart a fresh scent to a dry-cleaned object and to replenish fragrance depleted from the dry cleaning solvent. When present, the oil-based fragrance is generally included in an amount of about 1 wt. % to about 10 wt. %, for example about 2 wt. % to about 8 wt. %, or about 3 wt. %, based on the total weight of the detergent composition.

EXAMPLE

A detergent composition according to the disclosure is manufactured by adding deionized, filtered or tap water to an open blending tank at about 34 weight percent of the entire mixture to be blended. To the water, optical brighteners (e.g., TINOPAL CBS-X, available from Ciba Specialty Chemicals Inc.) are added with mixing, at about 0.05 weight percent of the entire mixture to be blended. The optical brighteners may be in a solid form and, if so, should be dissolved completely before adding the next ingredient to the open blending tank.

Next, a solubilizer (isopropanol) is added to the open blending tank, with mixing, at about 1 weight percent of the entire mixture to be blended.

Next, a coupling agent (hexylene glycol) is added to the open blending tank, with mixing, at about 6 weight percent of the entire mixture to be blended.

A blend of cationic surfactants is then added to and mixed with the contents of the blending tank. The cationic surfactants that are serially added include: about 3 weight percent tallowammonium ethosulfate (e.g., CRODAQUAT TES available from Croda, Inc.), about 23 weight percent quaternary ditallow amidoamine dimethyl sulfate (e.g., INCROSOFT 0-90HF available from Croda, Inc.), and about 13 weight percent quaternary cocamine methyl chloride (e.g., CRODAQUAT 1207 available from Croda, Inc.), based on the weight of the entire mixture to be blended.

Next, a fragrance (e.g., NEUTROLEUM ALPHA 288-575 available from Alpine) is added to the open blending tank, with mixing, at about 3 weight percent of the entire mixture to be blended.

Next, a halogenated solvent (n-propyl bromide) is added to the open blending tank, with mixing, at about 12 weight percent of the entire mixture to be blended.

Finally, an acid-accepting stabilizer (1,2-epoxybutane; available from BASF) is added to the open blending tank, with mixing, at about 4 weight percent of the entire mixture to be blended.

When the detergent composition is completely mixed, fluorinated 5-gallon high density polyethylene containers may be filled with the detergent composition. A lid with a spout may be used to seal the containers. The detergent composition can then be metered into a dry cleaning machine to help remove lipophilic and hydrophilic soils, soften and brighten fabrics, and reduce static cling.

The detergent composition can replenish fragrance depleted from the dry cleaning solvent, thereby providing fresh and clean smelling fabrics, rugs, and other articles. The detergent further replenishes the acid-accepting stabilizer depleted from the dry cleaning solvent to keep the dry cleaning solvent in service longer and to protect the metals from which the machine is made. The halogenated solvent of the composition suppresses the flash point of the acid-accepting stabilizer in the detergent container.

Because other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Accordingly, the foregoing description is given for clearness of understanding only, and no unnecessary limitations should be understood therefrom, as modifications within the scope of the invention may be apparent to those having ordinary skill in the art.

Throughout the specification, where the composition is described as including components or materials, it is contemplated that the compositions can also consist essentially of, or consist of, any combination of the recited components or materials, unless described otherwise. Combinations of components are contemplated to include homogeneous and/or heterogeneous mixtures, as would be understood by a person of ordinary skill in the art in view of the foregoing disclosure.

What is claimed is:

1. A detergent composition for use with halogenated dry cleaning solvents, comprising:

water;

a surfactant;

a solubilizer comprising an alcohol selected from the group consisting of methanol, ethanol, isopropanol, n-propanol, and mixtures thereof;

a coupling agent comprising an alkylene glycol;

an acid-accepting stabilizer comprising an epoxide; and a halogenated solvent.

2. The detergent composition of claim 1, wherein the halogenated solvent is selected from the group consisting of n-propyl bromide, perchloroethylene, trichloroethylene, and mixtures thereof.

3. The detergent composition of claim 2, wherein the halogenated solvent comprises n-propyl bromide.

4. The detergent composition of claim 1, wherein the epoxide is selected from the group consisting of 1,2-epoxybutane, pentylene oxide, hexylene oxide, and mixtures thereof.

5. The detergent composition of claim 4, wherein the acid-accepting stabilizer comprises 1,2-epoxybutane.

6. The detergent composition of claim 1, wherein the surfactant comprises a cationic surfactant selected from the group consisting of tallowammonium ethosulfate, dioleyl amidoamine dimethyl sulfate, cocamine methyl chloride, mono-oleyl imidazoline diethyl sulfate, dioleyl imidazoline dimethyl sulfate, ditallow amidoamine dimethyl sulfate, and mixtures thereof.

7. The detergent composition of claim 1, wherein the alkylene glycol is selected from the group consisting of ethylene glycol, diethylene glycol, triethylene glycol, propylene glycol, dipropylene glycol, tripropylene glycol, butylene glycol, pentylene glycol, hexylene glycol, heptylene glycol, and mixtures thereof.

8. The detergent composition of claim 1, further comprising: an oil-based fragrance.

9. The detergent composition of claim 1, further comprising: an optical brightener.

10. The detergent composition of claim 1, further comprising: a non-ionic surfactant.

11. The detergent composition of claim 1, wherein the surfactant comprises an anionic surfactant selected from the group consisting of petroleum sulfonates, sodium sulfosuccinates, sodium alkylarenesulfonates, amine alkylarene sulfonates, linear alkyl benzenesulfonic acid salts, alkaryl sulfonates, sodium sulfonates, sulfosuccinates, fluorinated carboxylic acids and their derivatives, and mixtures thereof.

12. The detergent composition of claim 1, wherein the surfactant comprises a non-ionic surfactant selected from the group consisting of secondary alcohol ethoxylates, octyl phenol ethoxylates, nonyl phenol ethoxylates, ethoxylated alkanolamides, fatty acid esters, ethoxylated phosphate esters, phosphate esters, oxyethylated isononylphenols, diethanolamine, sorbitan esters, polydimethylsiloxanes, alkyl-dimethicone copolyols, and mixtures thereof.

13. The detergent composition of claim 1, wherein the surfactant comprise an amphoteric surfactant selected from the group consisting of amine oxides, betaines, sultaines, acetates, glycinates, imidazolines, propionates, and mixtures thereof.

14. A detergent composition for use with halogenated dry cleaning solvents, comprising:

about 10 wt. % to about 90 wt. % water;

about 1 wt. % to about 60 wt. % of a cationic surfactant or a blend thereof, about 0.1 wt. % to about 5 wt. % of an alcohol solubilizer selected from the group consisting of methanol, ethanol, isopropanol, n-propanol, and mixtures thereof;

about 1 wt. % to about 20 wt. % of an alkylene glycol coupling agent;

about 1 wt. % to about 10 wt. % of an acid-accepting epoxide stabilizer selected from the group consisting of 1,2-epoxybutane, pentylene oxide, hexylene oxide, and mixtures thereof, and, about 1 wt. % to about 30 wt. % of n-propyl bromide;

wherein the weight percentages are expressed relative to the weight of the detergent composition.

15. The detergent composition of claim 14, further comprising: about 1 wt. % to about 10 wt. % of an oil-based fragrance.

16. The detergent composition of claim 14, further comprising: about 0.01 wt. % to about 0.3 wt. % of an optical brightener.

17. The detergent composition of claim 14, further comprising: up to about 10 wt. % of a non-ionic surfactant.

18. A detergent composition for use with halogenated dry cleaning solvents, comprising:

about 34 wt. % water;

about 0.05 wt. % of an optical brightener;

about 40 wt. % of a cationic surfactant blend;

about 1 wt. % isopropanol;

about 6 wt. % hexylene glycol;

about 3 wt. % of an oil-based fragrance;

about 4 wt. % 1,2-epoxybutane; and, about 12 wt. % n-propyl bromide;

wherein the weight percentages are expressed relative to the weight of the detergent composition.

* * * * *